US006648314B1

(12) United States Patent
Degen et al.

(10) Patent No.: US 6,648,314 B1
(45) Date of Patent: Nov. 18, 2003

(54) ECCENTRIC CLAMP CLIP

(75) Inventors: Klemens Degen, Weibern (DE); Zbigniew Noniewicz, Kempenich (DE); Theo Gasper, Burgbrohl (DE)

(73) Assignee: wolfcraft GmbH, Kempenich (DE)

( * ) Notice: Subject to any disclaimer, the term of this patent is extended or adjusted under 35 U.S.C. 154(b) by 0 days.

(21) Appl. No.: 09/979,963

(22) PCT Filed: May 12, 2000

(86) PCT No.: PCT/EP00/04294

§ 371 (c)(1),
(2), (4) Date: Feb. 11, 2002

(87) PCT Pub. No.: WO00/73026

PCT Pub. Date: Dec. 7, 2000

(30) Foreign Application Priority Data

May 27, 1999 (DE) ..... 299 09 191 U
Feb. 9, 2000 (DE) ..... 100 05 634

(51) Int. Cl.[7] ..... B25B 1/00
(52) U.S. Cl. ..... 269/6; 269/166; 269/170
(58) Field of Search ..... 269/6, 3, 166, 269/167, 170, 169, 168, 149, 203, 204, 205, 206

(56) References Cited

U.S. PATENT DOCUMENTS 4,926,722 A * 5/1990 Sorensen et al. ..... 81/487
5,584,458 A * 12/1996 Rando ..... 248/231.41
5,853,168 A * 12/1998 Drake ..... 269/6

* cited by examiner

*Primary Examiner*—George Nguyen
*Assistant Examiner*—Daniel Shanley
(74) *Attorney, Agent, or Firm*—Bell, Boyd & Lloyd LLC

(57) ABSTRACT

A clamp has a first clamping jaw support (2) which can be displaced along a slide bar (1) and fixed thereon by applying a tilting moment. The clamping jaw support has a first clamping jaw (3), certain areas of which lie at a distance from the slide bar (1) and a second clamping jaw support (4) which is located and substantially fixed in the area of one end of the slide bar. The second clamping jaw support has a second clamping jaw (5) which is located opposite the first clamping jaw (3) and which is displaced towards the first clamping jaw (3) when the clamping jaw support is impinged upon by an eccentric pressure element (6), located at the end of the slide bar. The second clamping jaw support (4) can be pivoted about a shaft (13) which fixes it to the slide bar (1). The eccentric pressure element (6) acts upon a pressure shoulder (7) of the second clamping jaw support (4) which obliquely crosses the slide bar (1).

11 Claims, 4 Drawing Sheets

1
6'
12
14
6
20
19
15
18
21
22
24
16
17
25
VI
VI
25
23
26
26
6
16
26
23

ECCENTRIC CLAMP CLIP

CROSS REFERENCE TO RELATED APPLICATIONS

This application claims priority of international application number PCT/EP00/04294 filed May 12, 2000, German Patent Application number 29909191.0 filed May 27, 1999, and German Patent Application number 10005634.2 filed Feb. 9, 2000, the entire disclosures of which are incorporated herein by reference.

BACKGROUND OF THE INVENTION

The present invention relates to a clamp clip. In an embodiment, the present invention relates to a clamp clip with a first clamping jaw carrier, which can be displaced along a slide bar and fixed thereon by applying a tilting moment, the first clamping jaw carrier having a first clamping jaw, at least certain regions of which are at a spacing from the slide bar, and with a second clamping jaw carrier, which is located and substantially fixed in the region of one end of the slide bar. The second clamping jaw carrier has a second clamping jaw, which is located opposite the first clamping jaw and which is displaced toward the first clamping jaw when the second clamping jaw carrier is impinged upon by an eccentric pressure element, located at the end of the slide bar.

An eccentric clamp clip is known in the prior art. The eccentric pressure element has a lever arm which can be pivoted about a pin at its end. As this happens, the eccentric surface presses on a pressure shoulder of the second clamping jaw, so that the clamping jaw can be brought into the clamping position.

An object of the present invention is to provide an improved clamp clip in a functionally advantageous manner by simple means.

SUMMARY OF THE INVENTION

The object is achieved by the invention specified in the claims.

In an embodiment, the present invention provides, in particular, that the second clamping jaw carrier can be pivoted about a pin, by which it is mounted on the slide bar. In a preferred configuration, the pin, by which the eccentric pressure element is pivotably mounted on the slide bar, and the axis about which the second clamping jaw carrier can be pivoted are parallel to each other. In a preferred configuration, the pressure shoulder against which the eccentric pressure element presses with its eccentrically shaped peripheral surface obliquely crosses the slide bar. The eccentric surface preferably merges into a surface portion of the operating handle.

The second clamping jaw carrier can be held in a pivoted end position by means of a spring. Preferably, the pivoted end position is a position in which the first clamping jaw is directed away from the second clamping jaw, so that the pressure shoulder rests against the eccentric surface of the pressure element under the action of spring force in the non-clamping position as well. Consequently, for example, the position of the operating handle when a workpiece is not clamped between the two clamping jaws is held in any desired pivoted position in a frictionally engaged manner.

The second clamping jaw is preferably located pivotably on the second clamping jaw carrier. The surface of the second clamping jaw can consequently adapt itself to the surface conditions of the workpiece to be clamped.

Moreover, this pivoting capability makes it possible to compensate for the turning of the clamping jaw carrier about its axis caused during clamping by the eccentric displacement. In a preferred configuration, the second clamping jaw carrier forms a pivot socket. Located in this pivot socket is a pivot bearing of the second clamping jaw. The pivot bearing is preferably clipped in the pivot socket.

Kinematic advantages are brought about by the pivot axis of the clamping jaw carrier being off-center with respect to the longitudinal axis of the slide bar. The axis in this case lies on the side of the center line of the slide bar facing away from the clamping jaw. The slide bar preferably has a rectangular cross-section and is produced from steel. The pivot axis of the eccentric pressure element preferably likewise lies off-center with respect to the longitudinal center plane of the slide bar. However, this axis lies on the other side of the longitudinal axis, that is on the side facing toward the clamping jaw.

The pivoting of the clamping jaw carrier on the bar and the arrangement of the eccentric pressure element in the direction of extent of the bar provide improved lever ratios for clamping. The slope of the spiral clamping surface is made to match the clamping arm, and to be geometrically designated as an angle lever.

In a development of the present invention, the pressure element can be brought into the clamping position in a ratcheted manner. A latching element is associated with the pressure element or the operating handle extending from the pressure element. The latching element engages with its latching teeth in a counter-latch located on the slide bar. The counter-latch may preferably be formed by a cylindrical element, the peripheral surface of which has latching niches. The latching cylinder is preferably carried by one end of the slide bar. The latching element can be brought into a release position by means of an unlatching lever. Preferably, both the latching element and the unlatching lever are located in a U-shaped hollow of the handle made of plastics. Both the latching element and the latching lever may be formed as plastic parts and are respectively able to pivot about separate pivot axes. The latching element preferably has a multi-arm form. One arm forms the pivot axis. Another arm forms the latching teeth. A further arm may interact with the return spring. Finally, a fourth arm may be provided on which the unlatching lever acts. The unlatching lever may be made of a two-arm form. The release arm of the latching element may be located in a mouth of a fork of the unlatching lever. When the cylindrical latching element is completely enclosed in the pressure element, the device has a pleasing appearance.

Additional features and advantages of the present invention are described in, and will be apparent from, the following Detailed Description of the Invention and the figures.

BRIEF DESCRIPTION OF THE FIGURES

Exemplary embodiments of the invention are explained below on the basis of attached drawings.

DETAILED DESCRIPTION OF THE INVENTION

Figure 2:
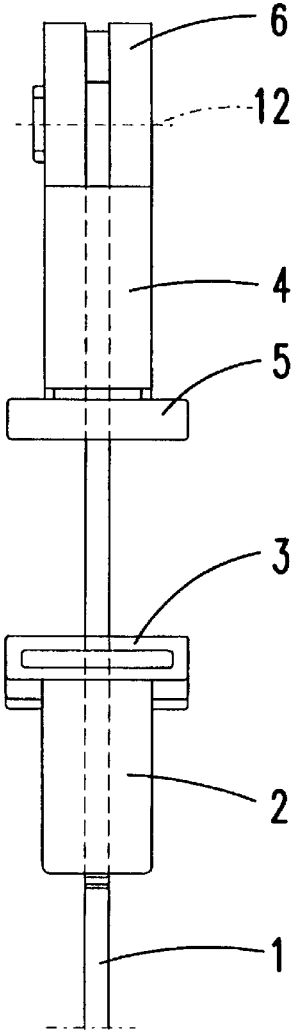
FIG. 2 shows the eccentric clamp clip of FIG. 1 in a representation turned through 90°.
Figure 1:
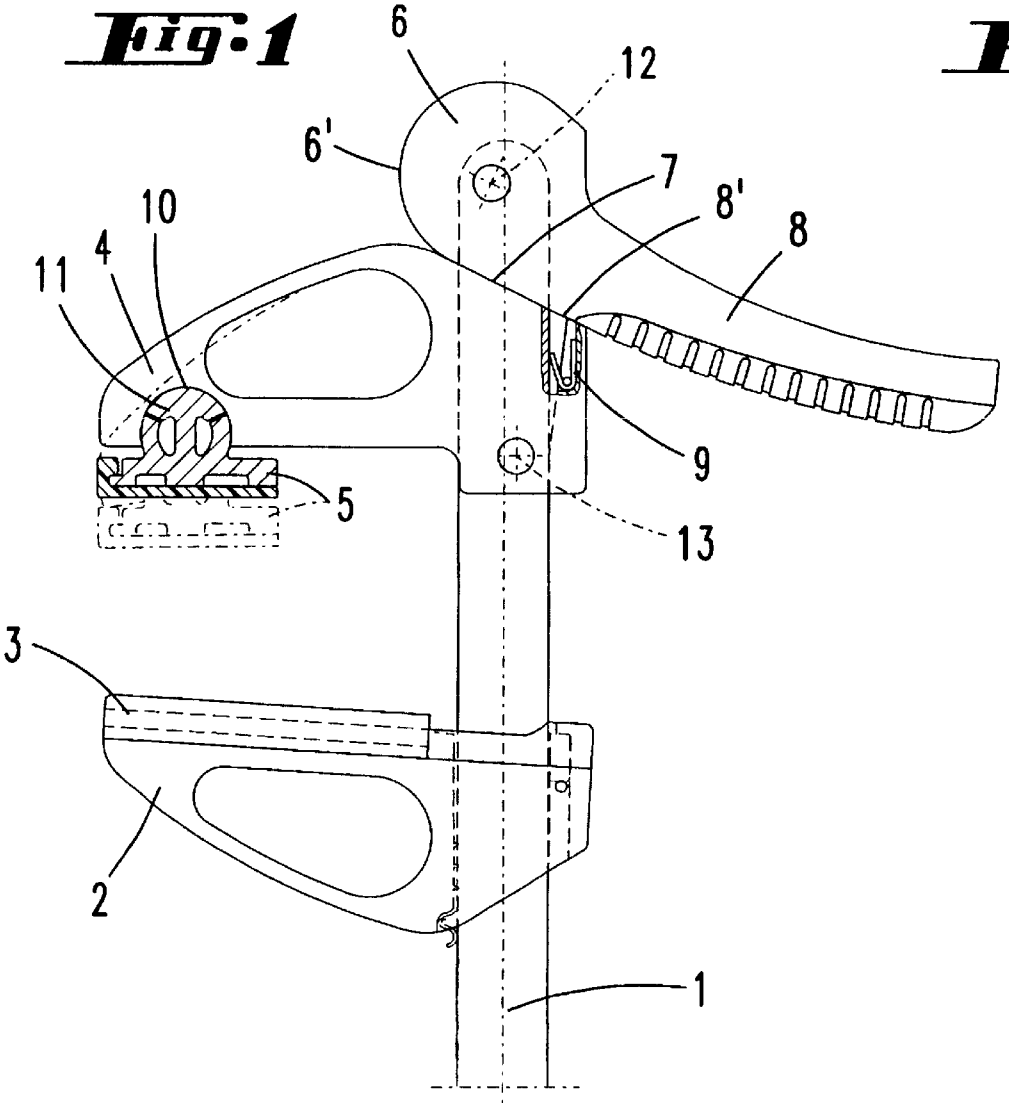
FIG. 1 shows an eccentric clamp clip in side view according to the present invention.
Figure 3:
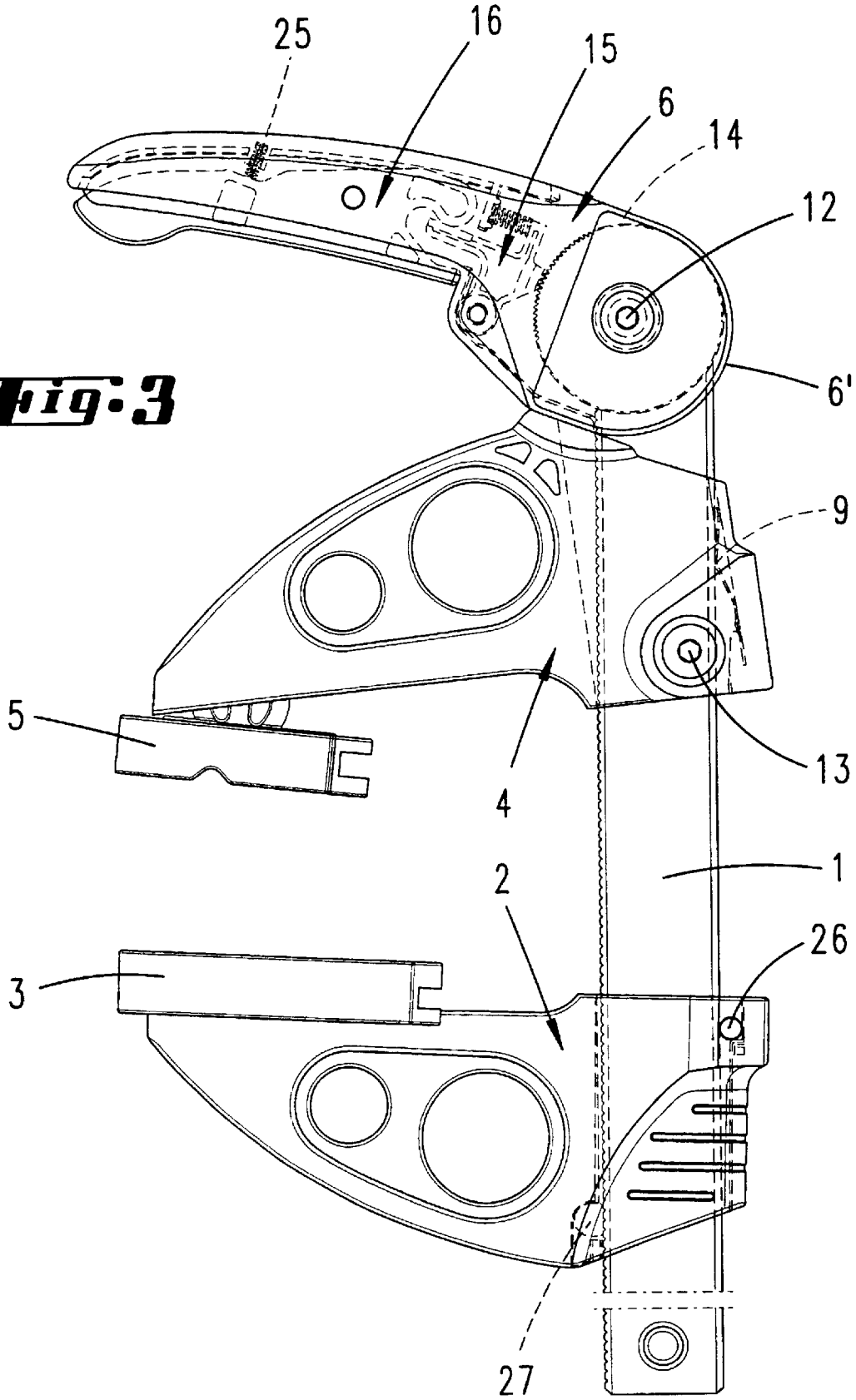
FIG. 3 shows a second exemplary embodiment of an eccentric clamp clip according to the present invention.
Figures 4, 6:
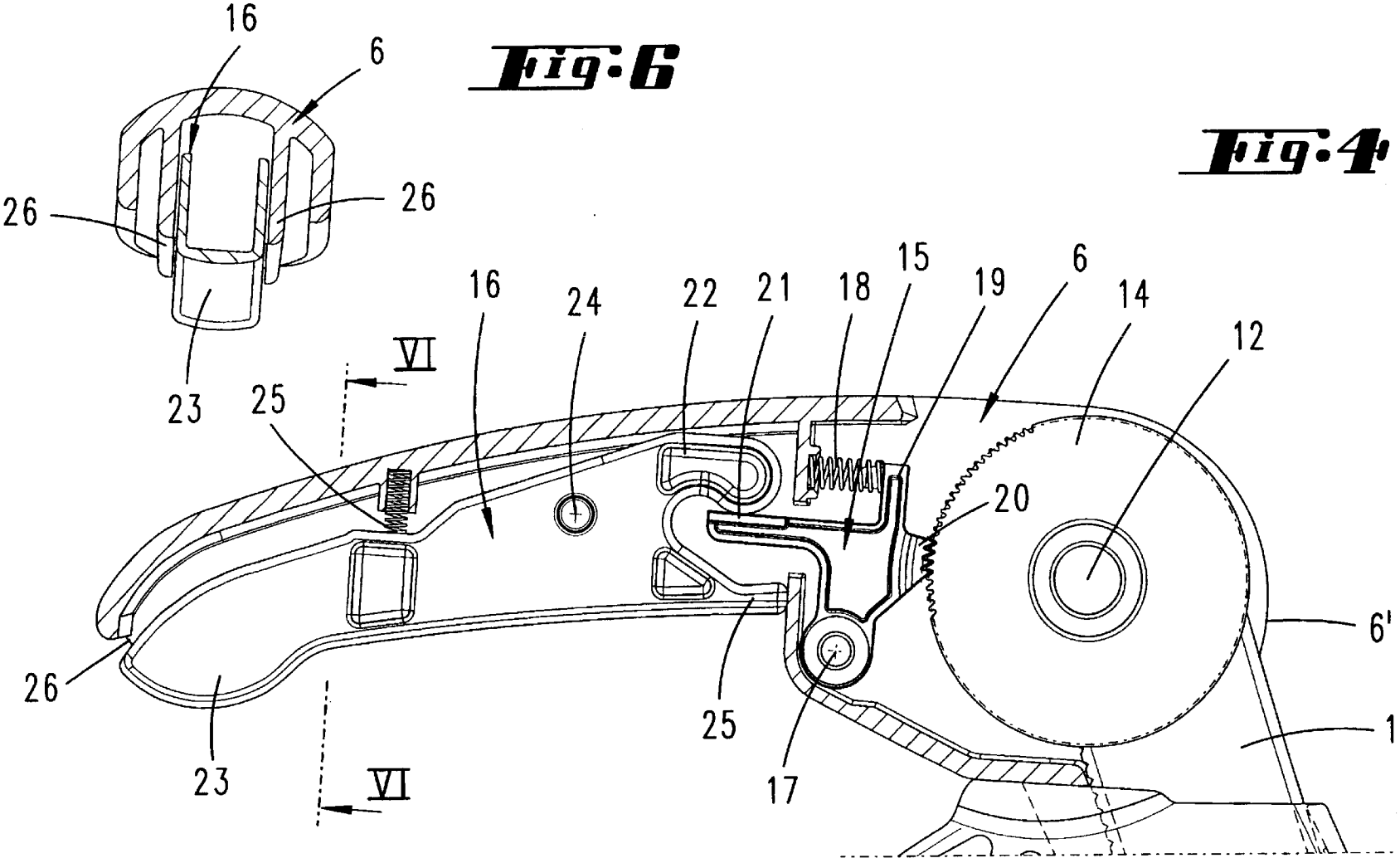
FIG. 4 shows an enlarged representation of the latching mechanism in the operating handle in the latched position.
FIG. 6 shows a section view along the line VI—VI in FIG. 4.
Figure 5:
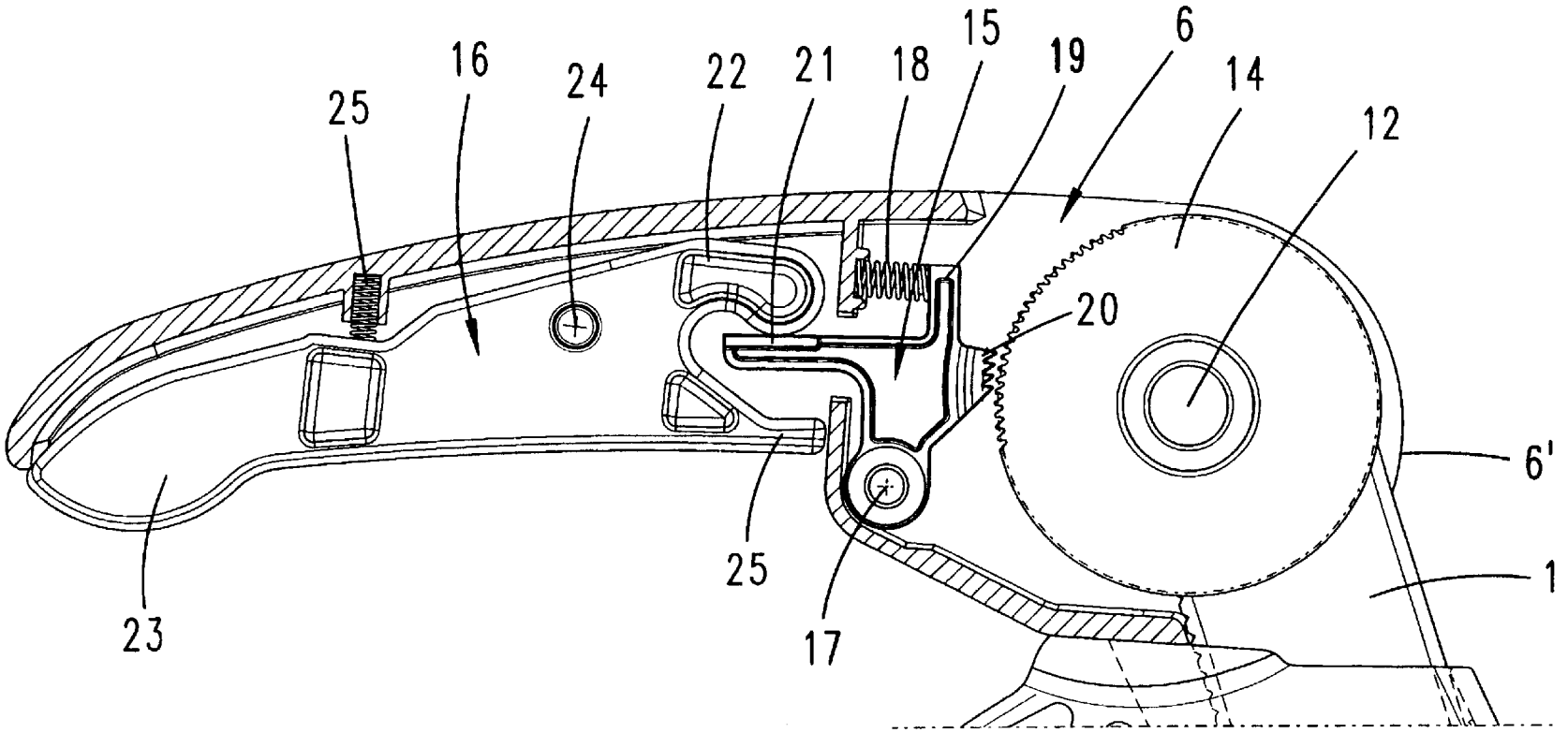
FIG. 5 shows a representation of the latching mechanism according to FIG. 4 in the release position.

Referring to FIGS. 1 and 2, the slide bar 1, made from steel, has a rectangular cross-section and a longitudinal center line indicated by a dash-dotted line. Displaceably mounted on the slide bar 1 is a first clamping jaw carrier 2. The clamping jaw carrier 2 has a first clamping jaw 3, which lies at a lateral spacing from the slide bar 1. If a moment is exerted on the clamping jaw 3, the clamping jaw carrier 2 tilts on the slide bar 1 and is securely fixed in place. The slide bar may be fluted on one or both sides.

Provided opposite to the clamping jaw 3 is a second clamping jaw 5. The clamping jaw 5 is made of plastics in a way similar to the clamping jaw carrier 2 and the clamping jaw 3 carried by the clamping jaw carrier 2. The clamping jaw 5 forms a pivot bearing 11, which is molded onto the clamping jaw 5. The pivot bearing 11 is clipped into a pivot socket 10, which is formed by a second clamping jaw carrier 4, likewise made of plastics.

The second clamping jaw carrier 4 is securely mounted on the slide bar 1 in such a way that it can pivot about an axis 13. For this purpose, the clamping jaw carrier 4, like the clamping jaw carrier 2, defines a compartment through which the slide bar 1 extends. This compartment surrounds the slide bar 1 with sufficient play that the clamping jaw carrier 4 can be pivoted about the pivot axis 13. The axis 13 is defined by a steel pin, which extends through an off-center bore in the slide bar 1. The bore, for example, lies on the side of the slide bar 1 facing away from the clamping jaw 5.

While the axis 13 lies approximately at the height of the clamping jaw 5, a pressure shoulder 7 obliquely crossing the slide bar 1 lies on the other side of the compartment and defines the opening of the compartment.

At the end of the slide bar 1 there is likewise an off-center bore. However, this off-center bore lies on the side of the center line of the slide bar 1 facing toward the clamping jaw 5. A pin 12 is inserted through this bore. The pin 12 defines the pivot axis for an eccentric pressure element 6.

The eccentric pressure element 6 is likewise made of plastics and defines a pressure surface 6', which extends spirally in relation to the pivot pin 12 and merges smoothly into a surface 8' of an operating handle 8 molded onto the pressure element 6.

In the compartment through which the slide bar 1 passes through the second clamping jaw carrier 4 there is also a spring element 9, which is supported on one side on the compartment wall and on the other side on the slide bar. The spring element 9 exerts a spreading action, by which the clamping jaw 5 is pressed counter to the direction of the pressure of the pressure element 6 against the eccentric surface 6', so that the pressure element 6 is held in every pivoted position in a frictionally engaged manner.

In the case of the exemplary embodiment represented in FIGS. 3 to 6, the position of the operating handle 8 and the position of the pressure element 6 can be fixed with respect to the pressure shoulder 7 by latching. For this purpose, a latching cylinder 14 is located at the end of the slide bar 1 at which the pressure element 6 is mounted. The latching cylinder 14 can be mounted at the end of the slide bar 1 by means of the pin 12. On the peripheral surface of the latching cylinder 14 there are latching niches extending in the axial direction of the cylinder. Latching teeth 20 of a latching element 15 engage in the latching niches.

The latching element 15 is mounted on the operating handle 8 by means of a pivot pin 17. In a way similar to an unlatching lever 16 (described below), the latching element is located in a U-shaped hollow of the handle 8. The latching element 15 forms four arms. One arm forms the pivot bearing 17. A second arm forms the latching teeth 20. An arm 21 located opposite the arm forming the latching teeth is a release arm. It can be acted upon by a pressure arm 22 of the unlatching lever 16 and lies in a mouth of a fork, which is formed by the pressure arm 22 and a second arm 25 of the unlatching lever 16.

A spring arm 19 located opposite the arm carrying the pivot pin 17 is biased by means of a compression spring 18 in the latching direction with respect to the housing of the operating handle 8.

The unlatching lever 16 is a two-arm lever. One arm forms the pressure arm 22. The longer arm, located opposite in the extended position, forms an operating arm 23, which in certain regions protrudes out of the U opening of the operating handle 8. The operating arm 23 is biassed by a compression spring 25 with respect to the U leg of the hollow of the handle 8. The compression spring 25 provided for this purpose lies in a corresponding spring-receiving chamber of the operating handle 8.

Two legs 26, which are molded onto the handle, extend in the longitudinal direction of the handle. These serve as a guide for the operating arm 23 of the unlatching lever 16.

For latching with the teeth of the slide bar 1, the displaceable clamping jaw carrier 2 has a latching pin 27, which is embedded in the clamping jaw carrier 2 consisting of plastics. In an axially offset opposite position in relation to the toothed pin 27, the clamping jaw carrier 2 carries an abutment pin 26, with which the clamping jaw carrier 2 can support itself on the side of the bar 1 located opposite the tooth arrangement. The teeth of the toothed pin 27 are pressed into the tooth arrangement by exertion of a torque on the clamping jaw 3. The countertorque is taken up by the pin 26.

The eccentric clamp clip operates as follows. A workpiece, not represented, is preliminarily clamped between the clamping jaws 3 and 5 in such a way that the displaceable clamping jaw carrier 2 is pushed toward the fixed but pivotable clamping jaw carrier 4 until the workpiece lies in a clamping position between the clamping jaw 3 and the clamping jaw 5. In this position, the pressure element 6 assumes such a pivoted position that the radially smallest portion of the eccentric surface 6' lies on the pressure shoulder 7. If the pressure element 6 is now pivoted about its pin 12 by engaging on the operating handle 8, the radially larger portions of the eccentric surface 6' come into contact with the pressure shoulder 7 and pivot the clamping jaw carrier 4 in the direction of the workpiece, so that the pressure with which the clamping jaw 5 acts on the workpiece is increased. As this happens, the spring 9 is loaded.

In overall technical terms, the clamping jaw carrier 4 forms an angle lever. The lever pivot axis is defined by the mounting pin 13. The one lever arm ends at the clamping jaw 5 and the second lever arm, extending away at an acute angle thereto, is formed by the pressure shoulder 7. The pressure shoulder 7 crosses the dash-dotted longitudinal center plane of the slide bar 1 at an acute angle. This angle is more obtuse, however, than the angle between the pressure point of the eccentric surface 6' on the pressure shoulder 7 and the axis 13 with the longitudinal center plane.

In the case of the exemplary embodiment represented in FIGS. 3 to 6, the operating handle can be latched in its pivoted positions in the clamping direction. For this purpose, the latching teeth 20 described above engage in the latching niches of the latching element 14. The force of the compression spring 18 provides the necessary contact pressure. If the unlatching lever 16 is operated, that is the operating arm 23 is pivoted into the U-shaped hollow, the pressure arm 23 presses on the release arm 21, so that the teeth 20 are disengaged from the latching niches. Then the operating arm can be pivoted in the way described above in both pivoting directions. Release of the clamping jaw 5 from the workpiece is possible in this way.

All features disclosed are (in themselves) pertinent to the invention. The disclosure content of the associated/attached priority documents (copy of the prior application) is hereby also fully incorporated into the disclosure of the patent application, including for the purpose of incorporating features of these documents in claims of the present patent application.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A clamp, comprising:

a slide bar defining a longitudinal centerline;

a first clamping jaw carrier mounted on the slide bar and having a first clamping jaw;

a second clamping jaw carrier mounted on the slide bar and having a second clamping jaw, the second clamping jaw carrier pivotable about a carrier pivot axis located on one side of the longitudinal centerline of the slide bar; and an eccentric pressure element mounted to the slide bar and pivotable about a pressure element pivot axis located on an opposite side of the longitudinal centerline of the slide bar relative to the carrier pivot axis of the second clamping jaw carrier, the carrier pivot axis and the pressure element pivot axis defining an oblique line relative to the longitudinal centerline of the slide bar, the eccentric pressure element operatively contacting the second clamping jaw carrier and applying a clamping force when pivoted about the pressure element pivot axis.

2. The clamp of claim 1, further comprising an operating handle connected to the eccentric pressure element, the eccentric pressure element having an eccentric surface which merges substantially smoothly into a surface of the operating handle and operatively contacts a pressure shoulder of the second clamping jaw carrier.

3. The clamp of claim 1, further comprising a biasing member biasing the second clamping jaw carrier to a pivoted position away from the first clamping jaw.

4. The clamp of claim 1, wherein the second clamping jaw has a pivot bearing; and the second clamping jaw carrier has a pivot socket, the second clamping jaw pivotally connected to the second clamping jaw carrier with the pivot bearing positioned in the pivot socket.

5. The clamp of claim 1, wherein the carrier pivot axis is located on a side of the longitudinal centerline of the slide bar opposite of the second clamping jaw, and the pressure element pivot axis is located on the same side of the longitudinal centerline of the slide bar as the second clamping jaw.

6. The clamp of any one of claims 1–5, wherein the eccentric pressure element has a first latching element engaged with a second latching element such that the eccentric pressure element can be placed in a clamping position in a ratcheted manner, and the clamp further comprising an unlatching lever operatively associated with at least one of the first and second latching elements to release the engagement of the first and second latching element.

7. The clamp of claim 6, further comprising an operating handle connected to the eccentric pressure element, and wherein the first latching element is a latching cylinder, the latching cylinder and the unlatching lever located in a hollow of the operating handle.

8. The clamp of claim 7, wherein the operating handle has first and second legs with the hollow between the first and second legs, the unlatching lever extends between the first and second legs.

9. The clamp of claim 6, further comprising a biasing member which biases the second latching element toward the first latching element, and wherein the second latching element has a release arm acted upon by a pressure arm of the unlatching lever against a biasing force of the biasing member.

10. The clamp of claim 7, wherein the latching cylinder is positioned inside of the eccentric pressure element.

11. A clamp clip having a slide bar which extends in the direction of its longitudinal center line, and having a first clamping jaw carrier, which can be displaced along the slide bar and can be fixed thereon by applying a tilting moment, said first clamping jaw carrier having a first clamping jaw, at least certain regions of which are at a spacing from the slide bar, and the clamp clip having a second clamping jaw carrier, which is located in a region of one end of the slide bar, said second clamping jaw carrier having a second clamping jaw, which is located opposite the first clamping jaw and which is displaced towards the first clamping jaw when the clamping jaw carrier is impinged upon by a pivotably mounted eccentric pressure element located at the one end of the slide bar, wherein the eccentric pressure element acts on a pressure shoulder of the second clamping jaw carrier crossing the slide bar obliquely to the longitudinal center line of the bar, the second clamping jaw carrier being pivotable about a mounting axis located between the pressure element and the first clamping jaw carrier.

* * * * *